US006395162B1

(12) United States Patent
Watanabe et al.

(10) Patent No.: US 6,395,162 B1
(45) Date of Patent: May 28, 2002

(54) CAR BODY COATING PROCESS

(75) Inventors: Tadashi Watanabe, Hiratsuka; Tadayoshi Hiraki, Odawara; Akira Tominaga, Chigasaki; Takeshi Yawata, Hiratsuka, all of (JP)

(73) Assignee: Kansai Paint Co., Ltd., Hyogo-ken (JP)

( * ) Notice: Subject to any disclaimer, the term of this patent is extended or adjusted under 35 U.S.C. 154(b) by 0 days.

(21) Appl. No.: 09/369,202

(22) Filed: Aug. 6, 1999

(30) Foreign Application Priority Data

Aug. 6, 1998 (JP) ..... 10-233508
May 28, 1999 (JP) ..... 11-149988

(51) Int. Cl.[7] ..... B41M 5/20; C25D 7/00; H01M 4/02

(52) U.S. Cl. ..... 205/50; 204/471; 204/499; 204/504; 204/505; 204/506

(58) Field of Search ..... 204/504, 505, 204/506, 499, 471; 205/50

(56) References Cited

U.S. PATENT DOCUMENTS 4,410,657 A * 10/1983 Loch ..... 204/508
5,439,710 A * 8/1995 Vogt et al. ..... 427/407.1

FOREIGN PATENT DOCUMENTS

JP 55-41317 10/1980

* cited by examiner

*Primary Examiner*—Bruce F. Bell
*Assistant Examiner*—Wesley A. Nicolas
(74) *Attorney, Agent, or Firm*—Wenderoth, Lind & Ponack, LLP

(57) ABSTRACT

A car body coating process of forming a shell body using a metal plate covered with a preformed film or shield to the main outer portions of a car body, or forming a shell body equipping car parts, which have been made by cutting, molding and joining a plastics-covered metal plate for the main outer portions of a car body, to a previously assembled main body of a car body, and then coating the exposed metal portion in the shell body by electrodeposition.

12 Claims, No Drawings

CAR BODY COATING PROCESS

The present invention relates to a car body coating process in which a shell body is formed using plastics-covered metal plates to a portion or whole of the shell body of a car body and the exposed metal portion of the shell body is coated by electrodeposition.

In a car body of a normal or small passenger car, the portion constituted mainly with sheet metal without riggings such as engine or chassis is called shell body which is constituted usually with a main body consisting of underbody, side member, roof, cowl, upper back, lower back etc. and outer cover parts such as hood, front balance, front fender, cowl louver, door, luggage (back door) etc.

Up to the present, in order to form these main body and outer cover parts, metal plate is cut and molded in the size and form of each constituting part and the parts are assembled to a shell body which is dipped into an electrodeposition paint bath to form a primer film on the surface, backside, edge surface portion etc. by electrodeposition coating. Intermediate paint, topcoat paint etc. are then coated to these outer portions.

Recently, however, operation step saving, energy saving and $CO_2$ reduction in the coating line is strongly desired also in the coating of a car body. Moreover, further improvement in throwing power of electrodeposition paint to edge surface portion, chipping resistance of the total coating film, corrosion resistance etc.

In the coating of a car body, on the other hand, there is proposed an inverse method (for example, Japanese Patent Publication No. 41317/1980), in which a substrate is powder-coated and the uncoated portion is coated by electrodeposition, for the purpose of the reduction of solvent discharge and improvement of edge surface coatability of electrodeposition paint. This method has, however, such problems as that powder coating facilities become additionally necessary, and that the corrosion resistance of the boundary portion between powder coating film and electrodeposition coating film is not sufficient.

The present inventors have repeatedly conducted studies to solve the above-mentioned problems in the coating of a car body. As a result, this time, they found that the above-mentioned problems can be solved by one effect by forming a shell body by using a metal plate covered with plastics layer, which has been prepared previously, to a portion or whole of the shell body of a car body, and coating the exposed metal portion in the shell body by electrodeposition.

Thus, according to the present invention there is provided a car body coating process characterized by forming a shell body using a plastics-covered metal plate to the main outer parts of a car body, and then coating the exposed metal portion in the shell body by electrodeposition (this process is hereinafter referred to as Process I).

According to the present invention there is provided also a car body coating process characterized by forming a shell body equipping car parts, which have been made by cutting, molding and joining a plastics-covered metal plate for the main outer portions of a car body, to a previously assembled main body of a car body, and then coating the exposed metal portion in the shell body by electrodeposition (this process is hereinafter referred to as Process II).

Then, the car body coating process of the present invention is described in more detail.

The process of the present invention can be applied mainly to normal and small passenger car, but can be also applied to truck, bus, motorcycle, vehicle with special kind of equipment car etc. in the same manner.

As a metal plate to be covered with plastics, metals, which have been used for a car body up to the present, can be similarly used. As the material, there may be mentioned, for example, iron, steel, stainless steel, aluminum, copper, and alloys containing these metals, and further plate of these metals whose surface is plated with zinc, zinc/nickel, iron etc. They can be used usually in coils or processed in cut plates. The thickness of these metal plates is suitably in the range of generally 0.3–2.0 mm, particularly 0.5–1.0 mm and the surface of these metal plates is preferable to be treated suitably by grinding, degreasing, with phosphate etc. in order to improve the adhesivity with a plastics layer, corrosion resistance etc.

As plastics materials to cover the above-mentioned metal plates, there can be used per se known thermoplastic resins, for example, polyolefin resin such as polyethylene, polypropylene etc., polyester resin such as polyethylene terephthalate (PET) etc., polycarbonate resin, epoxy resin, vinyl acetate resin, vinyl chloride resin, fluorine-containing resin, polyvinyl acetal resin, polyvinyl alcohol resin, polyamide resin, polystyrene resin, acrylic resin, polyurethane resin, phenolic resin, polyether resin, cellulose type resin etc. They may contain color pigment, extender pigment etc.

Covering of a metal plate with these plastics materials can be performed by per se known methods including, for example, sticking onto the metal plate plastics in film or sheet formed by the methods such as extrusion molding, injection molding, calender molding, compression molding etc.; sticking with pressure onto the metal plate molten plastics extruded in film or sheet; adhering plastics in powder form onto the metal plate by the methods such as fluidized immersion, electrostatic coating etc. and then melting by heating. Particularly the process of sticking plastics in film or sheet onto the metal plate is preferable. Covering of a metal plate with plastics is performed at least to the surface of a metal plate located at outer side of a car body. However, it is possible to cover both surfaces, if desired. The thickness of the plastics layer covering a metal plate is preferable in the range of usually 1–100 $\mu$m, particularly 3–75 $\mu$m, more particularly 5–50 $\mu$m. Moreover, it is possible to treat the surface of these plastics by corona discharge, plasma, flame etc. before or after the covering onto the metal plate.

On covering a metal plate with plastics, in case of sticking plastics in film or sheet onto the metal plate, it is preferable to previously coat an adhesive to the metal plate and/or plastics film or sheet, in order to increase adhesivity between the two. As such an adhesive there may be mentioned thermosetting or thermoplastic adhesives containing one or more kinds of resins selected from, for example, bisphenol type epoxy resin, resol type epoxy resin, acrylic resin, aminoplast resin, polyester resin, urethane resin, polysiloxane resin etc., and further containing optionally a curing agent. Further, there can be used as adhesive triazinethiol type compounds such as 2,4, 6-trimercapto-S-triazine, 2-dibutylamino-4, 6-dimercapto-S-triazine, 2,4,6-trimercapto-S-triazine-monosodium salt, 2,4,6-trimercapto-S-triazine-trisodium salt etc.

In the Process I according to the present invention, a shell body is assembled by cutting, molding and joining the plastics-covered metal plates, which have been prepared as mentioned above. Specifically each part of the main body and outer cover parts is prepared using the plastics-covered metal plate, and then the parts are assembled to form a shell body.

Shell body is a portion in a car body, constituted mainly with sheet metal without riggings such as engine or chassis.

Its main body is constituted mainly with parts such as underbody, side member, roof, cowl, upper back, lower back etc. and the outer cover parts consists mainly of parts such as hood, front balance, front fender, cowl louver, door, luggage (back door) etc. Parts of outer cover parts are called car parts.

Underbody here means the floor portion of the cabin, trunk room etc. and is named generically, including front underbody, front floor, rear floor etc. Side member forms the side of a cabin joining with a front body, roof panel, underbody etc. and prevents the car from bending and/or twisting. Cowl is a panel combining left, right, front and rear pillars. Upper back is a panel combining left and right quarter panels (rear fender) at the back portion of a car body and forming outer surface of the car body.

In the Process I of the present invention, in order to form the above-mentioned parts constituting a shell body, a plastics covered metal plate, which has been prepared as mentioned above, is cut to the suitable shape and size, pressed and molded by a press etc., and joined by, as necessary, adhering with adhesive, welding, bolted etc. to prepare parts of the main body such as underbody, side member, roof, cowl, upper back, lower back etc.; and parts (car parts) of outer cover parts such as hood, front balance, front fender, cowl louver, door, luggage etc. These cutting, molding and joining can be performed by per se known methods. Then the parts of the main body thus formed using a plastics-covered metal plate are assembled and joined to form a main body, to which parts of outer cover parts (car parts) such as hood, front balance, front fender, cowl louver, door, luggage etc. are equipped.

While at least the outer surface of the shell body thus assembled using a plastics-covered metal plate is covered with a plastics layer, the edge surface portion of a cut plastics-covered metal plate has an exposed metal portion. Moreover, though the back side is preferably covered with plastics, a metal portion may be exposed. In the Process I of the present invention these exposed metal portions are then coated by electrodeposition.

On the other hand, in the Process II according to the present invention, parts of outer cover parts (car parts) such as hood, front balance, front fender, cowl louver, door, luggage etc. are prepared, using a plastics-covered metal plate, which has been prepared as mentioned above, by cutting, molding and joining them, and these car parts are equipped to a previously assembled main body of a car body to form a shell body. Among them, the preparation of parts of outer cover parts (car parts) can be performed in the same manner as in the above-mentioned Process I.

In the Process II of the present invention, most or the whole of the car parts, which constitute outer cover parts, are prepared using the above-mentioned plastics-covered metal plate. For example, in order to form each part constituting outer cover parts such as hood, front balance, front fender, cowl louver, door, luggage (back door) etc., a plastics-covered metal plate is cut to the suitable shape and size, pressed and molded by a press etc., and joined by, as necessary, adhering with adhesive, welding, bolting etc. to prepare parts (car parts) such as hood, front balance etc. These cutting, molding and joining can be performed by per se known methods. At least the outer surface of the parts of outer cover parts (car parts) thus formed is covered with a plastics layer and the edge surface portion of a cut steel plate has an exposed metal portion. The back side may be uncovered and have exposed metal, or may be covered with plastics.

In the Process II of the present invention, the main body constituted with underbody, side member, roof, cowl, upper back, lower back etc., to which these car parts are equipped, are prepared usually, without using a plastics-covered metal plate but using an uncovered metal plate, by cutting, molding and processing, and joining them by per se known methods. A shell body is formed by equipping the parts of outer cover parts (car parts) prepared using a plastics-covered metal plate to a main body prepared using such an uncovered metal plate. In the Process II of the present invention, the whole surface of the main body and the exposed metal portion of outer cover parts (car parts) in thus assembled shell body are coated by electrodeposition.

Electrodeposition paint to be used for the electrodeposition coating of the assembled shell body in the Processes I and II of the present invention may be either anionic type or cationic type. Generally, however, it is preferable to use a cationic type electrodeposition paint with excellent corrosion resistance.

As a cationic electrodeposition paint a known product can be used, for example, a water paint containing a base resin having a hydroxyl group(s) and a cationizable group(s) (a) and a blocked polyisocyanate compound (b).

As a base resin (a), for example, the following can be mentioned.

1) reaction product of epoxy resin and cationizing agent; 2) acid-protonized product of polycondensate of polycarboxylic acid and polyamine (cf. U.S. Pat. No. 2,450,940 Specification); 3) acid-protonized product of polyadduct of polyisocyanate compound, polyol and mono- or polyamine; 4) acid-protonized product of copolymer of acryl type or vinyl type monomers having hydroxyl group and amino group (cf. Japanese Patent Publications No. 12395/1970 and No. 12396/1970); 5) acid-protonized product polyadduct of polycarboxylic acid resin and alkyleneimine (cf. U.S. Pat. No. 3,403,088 Specification).

As specific examples and preparation processes of these base resins (a) are described, for example, in Japanese Patent Publications No. 12395/1970, No. 12396/1970, No. 23087/1974, U.S. Pat. No. 2,450,940, 3,403,088, U.S. Pat. No. 3,891,529, U.S. Pat. No. 30 3963663 etc., these literatures are quoted here instead of a detailed description.

Among these, a resin, obtained by reacting a cationizing agent to an epoxy resin, which is obtained by a reaction of poly-phenol compound and epichlorohydrin, and included in the above-mentioned 1), is particularly preferable due to its formation of a 5 coating film with excellent corrosion resistance.

As the above-mentioned epoxy resin it is particularly suitable to have more than 2 epoxy groups in the molecule, number average molecular weight of more than 200, preferably 800–2000, and epoxy equivalent in the range of 190–2000, preferably 400–1000. Such epoxy resins include polyglycidyl ether of polyphenol compound. As said polyphenol compound there can be mentioned, for example, bis(4-hydroxyphenyl)-2,2-propane, 4,4'-dihydroxybenzophenone, bis(4-hydroxyphenyl)-1,1-ethane, bis(4-hydroxyphenyl)-1,1-isobutane, bis(4-hydroxy-tert-butylphenyl)-2,2-propane, bis(2-hy-15 droxybutyl)methane, 1,5-dihydroxynaphthalene, bis(2,4-dihydroxyphenyl) methane, tetra(4-hydroxyphenyl)- 1,1,2,2-ethane, 4,4'-dihydroxydiphenyl ether, 4,4'-dihydroxydiphenyl sulfone, phenol novolac, cresol novolac etc.

These epoxy resins may be further modified by reacting with polyol, polyehter polyol, polyester polyol, polyamidoamine, polycarboxylic acid, polyisocyanate compound etc. and further may be graft-polymerized by e-caprolactone, acrylic monomer etc.

Cationizing agent in the above-mentioned 1) gives a base resin (a) having a hydroxyl group(s) and a cationazable group(s) by reacting with most or whole of the epoxy groups existing in the epoxy resin and introducing cationizable group such as secondary amino group, tertiary amino group, quaternary ammonium base etc. into the resin.

As such a cationazing agent there can be mentioned amine compound, for example, primary amine, secondary amine, tertiary amine, polyamine etc. Here, there can be mentioned as a primary amine compound, for example, methylamine, ethylamine, n-propylamine, isopropylamine, monoethanolamine, n-propano-lamine, isopropanolamine, etc.; as a secondary amine compound, for example, diethylamine, diethanolamine, di-n-propanolamine, diisopropanolamine, N-methylethanolamine, N-ethylethanolamine etc.; and as a tertiary amine compound, for example, triethylamine, triethanolamine, N,N-dimethylethanolamine, N-methyldiethanol-amine, N,N-diethylethanolamine, N-ethyldiethanolamine etc. As a polyamine there can be mentioned, for example, ethylenediamine, diethylenetriamine, hydroxyethylaminoethylamine, ethylamino-ethylamine, methylaminopropylamine, dimethylaminoethylamine, dimethylaminopropylamine etc.

Furthermore, it is possible to use a basic compound such as ammonia, hydroxylamine, hydrazine, hydroxyethylhydrazine, N-hydroxyethylimidazoline etc. as a cationazing agent to react with an epoxy group and to protonize the basic group formed therby with an acid to make it into a cationizable group. As an acid usable here a water-soluble organic carboxylic acid, for example, formic acid, acetic acid, glycolic acid, lactic acid etc., is preferable.

As a hydroxyl group in the base resin (a) there may be mentioned a primary hydroxyl group introduced by, for example, a reaction with an alkanol amine in the above-mentioned cationizing agent, a ring-opening reaction with caprolactone which may be introduced in the epoxy resin, a reaction with a polyol, etc.; a secondary hydroxyl group in the epoxy resin etc. Among them a primary hydroxyl group introduced by a reaction with an alkanolamine is preferable due to its excellent crosslinking reactivity with a blocked polyisocyanate compound (crosslinking agent). The amount of hydroxyl groups in the base resin (a) is preferably in the range of generally 20–5000 mgKOH/g, particularly 100–1000 mgKOH/g. Particularly it is preferable that the primary hydroxyl group equivalent be in the range of 200–1000 mgKOH/g as a hydroxyl group equivalent. The amount of a cationizable group is preferable to be more than the minimum limit necessary to stably disperse the base resin (a) in water and preferable in the range of generally 3–200, particularly 10–80 calculated as KOH (mg/g solid content) (amine value). It is desirable that the base resin (a) does not substantially contain a free epoxy group.

Blocked polyisocyanate compound (b) as a crosslinking agent is a compound in which substantially all isocyanate groups in the polyisocyanate compound are blocked by a volatile blocking agent. Upon heating it over the prescribed temperature the blocking agent is dissociated to regenerate an isocyanate group which takes part in the crosslinking reaction with the base resin (a).

Polyisocyanate compound is a compound having more than 2 free isocyanate groups in the molecule and includes, for example, aliphatic diisocyanate such as hexamethylene diisocyanate, trimethylene diisocyanate, tetramethylene diisocyanate, dimer acid diisocyanate, lysine diisocyanate etc.; alicyclic diisocyanate such as isophorone diisocyanate, methylenebis(cyclohexylisocyanate), methylcyclohexane diisocyanate, cyclohexane diisocyanate, cyclopentane diisocyanate etc.; aromatic diisocyanate such as xylylene diisocyanate, tolylene diisocyanate, diphenylmethane diisocyanate, naphthalene diisocyanate, toluidine diisocyanate etc.; urethanation adducts, biuret type adducts, isocyanuric ring type adducts of these polyisocyanate compounds etc.

As a blocking agent to block a free isocyanate group of these polyisocyanate compounds there can be used known blocking agents of phenol type, alcohol type, active methylene type, mercaptan type, acid amide type, imide type, amine type, imidazole type, urea type, carbamic acid type, imine type, oxime type, sulfurous acid type, lactam type etc.

Constitution ratio of the base resin (a) and the blocked polyisocyanate compound (b) is preferably for the former in the range of 40–90%, particularly 50–80%, and for the latter, 60–10%, particularly 50–20% based upon the total solid content weight of both components.

A cationic electrodeposition paint can be prepared, for example, by neutralizing a cationizable group in a base resin (a) with an acid compound such as acetic acid, formic acid, lactic acid, phosphoric acid etc. and then mixing in water together with a blocked polyisocyanate compound (b). The pH at the time of its coating is suitably in the range of generally 3–9, particularly 5–7 and the solid content concentration is suitably in the range of 5–30% by weight.

To a cationic electrodeposition paint there can be suitably compounded, as necessary, a curing catalyst having rust preventive properties such as hydroxide, oxide, organic acid salt, inorganic acid salt etc. of a metal selected from aluminum, nickel, zinc, strontium, lead, zirconium, molybdenum, tin, antimony, lanthanum, tungsten, bismuth etc.; extender pigment, color pigment, rust preventive pigment, antisettling agent etc.

In the present invention, an electrodeposition coating film can be deposited to an exposed metal portion in the shell body, for example, edge surface portion of a cut plastics-covered metal plate and the backside portion of said metal plate which is not covered with plastics, or the whole surface of the main body (in case of Process II) etc. by dipping a shell body prepared as mentioned above into a cationic electrodeposition paint bath, making it a cathode and conducting an electrodeposition coating for 1–10 minutes of passing a current, at 20–35° C. of bath temperature and 100–400 V of voltage. The thickness of an electrodeposition coating film is preferably in the range of usually about 10—about 40 $\mu$m, particularly 10–20 $\mu$m as a cured film. After the coating, the shell body is drawn up from the electrodeposition paint bath, washed suitably with water and heated to about 100 —about 200° C. to cure the electrodeposition coating film and thus to obtain a car body by the present invention.

Through the process of the present invention as mentioned above the following effects can be obtained.

(1) As the electrodeposition paint deposits easily at the boundary portion to the plastics covering film at the portion with exposed metal as a thick film, the corrosion resistance of this portion improves remarkably.

(2) As the main body, consisting of outer cover parts such as hood panel, fender panel, door panel, luggage door panel etc. of the car body and further underbody, side member, roof, cowl, upper back, lower back etc., can be prepared using metal plates which have been previously covered with plastics, it is possible to largely reduce the amount of the electrodeposition paint to be used at the next step.

(3) As at least the outer surface of outer cover parts is covered with a layer of plastics having a high volume specific resistance and, optionally, at least the outer surface of the main body is also covered with a layer of plastics having a high volume specific resistance, the area of the portion of shell body to be coated by electrodeposition (portion with exposed metal) is small and consequently the throwing power of the paint increases and particularly the corrosion resistance of the edge surface portion is improved.

(4) It is possible to give the properties, which the covering plastics have, such as chipping resistance, corrosion resistance etc. to a car body.

The present invention will be described more specifically by Examples and Comparative Examples. Parts and % are by weight and the film thickness is that of the cured film.

1. Preparation of Plastics-covered Metal Plate (a) Both sides of a polyester film with a film thickness of 16 μm were treated by corona discharge and one side was coated with a thermocurable polyester resin type adhesive to a film thickness of 7 μm, dried by heating at 120° C. for 30 seconds and wound up. Both sides of a cold rolled steel plate of 0.8 mm thickness was plated with alloyed molten zinc so that the plated amount be 45 g/m 2, degreased and chemically treated with zinc phosphate ("PB #3080 Treatment"; a product of Nihon Parkerizing Co., Ltd.). One side of this metal plate was covered with the above-mentioned polyester film by adhering with heat and pressure through the intermediary of the adhesive.

(b) A plastics-covered metal plate was prepared in the same manner as the above-mentioned (a) with the exception that the metal plate in the above-mentioned (a) was replaced by a cold rolled steel plate of 0.8 mm thickness which had been degreased and chemically treated with zinc phosphate ("PB #3080 Treatment"; a product of Nihon Parkerizing Co., Ltd.).

(c) Both sides of a polyester film with a film thickness of 16μm were treated by corona discharge and wound up. Both sides of a cold rolled steel plate of 0.8 mm thickness was plated with alloyed molten zinc so that the plated amount be 45 g/m$^2$, degreased and coated with 5% butyl-cellosolve diluted triazinethiol (made by Sankyo Kasei Co., Ltd.; trade name: "Jisnet F"). One side of this metal plate was covered with the above-mentioned polyester film by adhering with heat and pressure.

2. EXAMPLES AND COMPARATIVE EXAMPLES

Example 1

A model of a main body (size is about 1/25 of the actual thing), consisting of underbody, side member, roof, cowl, upper back and lower back, was previously prepared by cutting, molding and joining the plastics-covered metal plate (a). Further, models of parts of outer cover parts (car parts) (size is about 1/25 of the actual thing) such as hood outer cover parts, fender, door, luggage door etc. were prepared by cutting, molding and joining the plastics-covered metal plate (a).

A shell body was formed by equipping these outer cover parts to the main body and dipped into a cationic electrodeposition paint ("Elecron #9600 Gray", a product of Kansai Paint Co., Ltd; epoxy resin type) bath to coat the portion with exposed metal of the shell body under the conditions of bath temperature 28° C., voltage 250 V, and totally dipped current passing time 2 minutes. After washing with water the electrodeposition coating film was cured by heating at 170° C. for 30 minutes. The thickness of the flat portion of the electrodeposition coating film was 20 μm.

Example 2

A model of a main body (size is about 1/25 of the actual thing), consisting of underbody, side member, roof, cowl, upper back and lower back, was previously prepared by cutting, molding and joining alloyed molten zinc-plated metal plate with both uncovered sides.

On the other hand, models (size is about 1/25 of the actual thing) of parts of outer cover parts (car parts) such as hood, fender, door, luggage door etc. were prepared by cutting, molding and joining the plastics-covered metal plate (a).

A shell body was formed by equipping these outer cover parts to the main body and dipped into the same cationic electrodeposition paint bath as in the above-mentioned Example 1 to coat the portion with exposed metal of the shell body by electrodeposition under the conditions of bath temperature 28° C., voltage 250 V, and totally dipped current passing time 2 minutes. After washing with water the electrodeposition coating film was cured by heating at 170° C. for 30 minutes. The thickness of the flat portion of the electrodeposition coating film was 20 μm.

Example 3

The same operation as Example 2, except replacing the plastics-covered metal plate (a) in the above-mentioned Example 2 by the plastics-covered metal plate (b), was conducted.

Example 4

The same operation as Example 2, except replacing the plastics-covered metal plate (a) in the above-mentioned Example 2 by the plastics-covered metal plate (c), was conducted.

Comparative Example 1

The coating film, which had been coated by electrodeposition in that same manner as in Example 2, except that the plastics-covered metal plate (a) in Example 2 was replaced by an uncoated metal plate which had been plated with alloyed molten zinc so that the plated amount be 45 g/m$^2$ and then degreased and chemically treated with zinc phosphate ("PB #3080 Treatment"), was cured by heating.

Comparative Example 2

The coating film, which had been coated by electrodeposition in the same manner as in Example 2, except that the plastics-covered metal plate (a) in Example 2 was replaced by 0.8 mm thick cold rolled steel plate which had been degreased and chemically treated with zinc phosphate ("PB #3080 Treatment"), was cured by heating.

Comparative Example 3

The test piece, prepared by coating half of one side of cold rolled steel plate of a size 7 cm×15 cm×0.8 mm, which had been degreased and chemically treated with zinc phosphate (PB #3080), with the thermocurable powder paint mentioned below by an electrostatic powder coating machine so that the film thickness be 40 μm, and preheated at 95° C. for 10 minutes, was dipped into the cationic electrodeposition paint ("Elecron #9600 Gray") bath and the exposed metal portion of the test piece was coated by electrodeposition under the condition of electrodeposition bath temperature 28° C., voltage 250 V and totally dipped current passing time 2 minutes. After washing with water the coating film was cured by heating at 170° C. for 30 minutes. The thickness of the electrodeposition coating film was 20 μm.

Thermocurable powder paint: A thermocurable powder paint obtained by dry blending a mixture of 940 parts of "Epicoat 1004" (a product of Yuka Shell Epoxy K.K.; bisphenol A type epoxy resin), 60 parts of adipic acid hydrazide, 200 parts of titanium white pigment and 200 parts of baryta, dispersing through melt kneading by Buss Cokneader, cooling, rough crushing, fine grinding and 150-mesh filtration.

3. Performance Test Results

1) Various performance tests were conducted on the car shell bodies (model) after the electrodeposition coating obtained by Examples and Comparative Examples. The results are shown in Table 1.

TABLE 1

| | Examples | | | | Comparative Examples | | |
|---|---|---|---|---|---|---|---|
| | 1 | 2 | 3 | 4 | 1 | 2 | 3 |
| Chipping resistance | ○ | ○ | ○ | ○ | X | Δ | Δ |
| General portion corrosion resistance | ○ | ○ | ○ | ○ | Δ | Δ | — |
| Edge corrosion resistance | ○ | ○ | ○ | ○ | Δ | Δ | — |
| Boundary portion corrosion resistance | — | — | ○ | — | — | — | X |

Test methods are as follows.

Chipping resistance: Test was conducted on a coated plate obtained by coating a flat plastics-covered metal plate of the size 7 cm×15cm used for outer cover parts of the shell body model in Examples and Comparative Examples (in Comparative Examples, however, an electrodeposition-coated metal plate was used) with an intermediate paint ("Lugabake KPX-60", a product of Kansai Paint Co., Ltd.; polyester resin/amino resin type) to a film thickness of 25 μm, curing by heating at 140° C. for 30 minutes, then coating with a white top coat paint ("Amilac White", a product of Kansai Paint Co., Ltd.; polyester resin/amino resin type) to a film thickness of 35 μm, and curing by heating at 140° C. for 30 minutes. In Comparative Example 3, however, a coating with an intermediate paint was omitted.

Using "Q-G-R Gravelometer" (a product of Q Panel) as a testing machine, about 50 g of No. 7 crushed stones were blown onto the coating surface at an angle of 90° at −20° C. by an air pressure of about 4 kg/cm$^2$ . Then an adhesive cellophane tape was stuck on the coating surface, and the state of chipping of the coating film from the portion, on which the shock had been given, at the portion covered with plastics and the portion coated with powder paint, was visually observed, after rapidly peeling-off the adhesive tape.

○ shows that a little chipping of the topcoat coating film and intermediate coating film by shock was observed but there is no exposure of metal surface at all, Δ shows that much chipping of the topcoat coating film and intermediate coating film by shock was observed and there is a little exposure of metal surface, too, and X shows that much chipping of the topcoat coating film and intermediate coating film by shock is observed and there is much exposure of metal surface, too.

General portion corrosion resistance: After placing the models obtained in Examples and Comparative Examples in a salt water resistance spray test machine (35° C.) for 960 hours, the corrosion resistance at the outer portion of outer cover parts of the shell body, namely the portion covered with polyester film (Examples) and the portion coated by electrodeposition (Comparative Examples) was visually observed.

○ shows that no generation of rust or blistering is observed at all, A shows that a little generation of rust or blistering is observed, and X shows that much generation of rust or blistering is observed.

Edge corrosion resistance: After placing the models obtained in Examples and Comparative Examples in a salt water resistance spray test machine (35° C.) for 240 hours, the corrosion resistance at the edge surface portion of the cut portion of the shell body (acute angle portion) was observed.

○ shows that no generation of rust at the edge surface portion is observed at all, Δ shows that a little generation of rust at the edge surface portion is observed, and X shows that much generation of rust at the edge surface portion is observed.

Boundary portion corrosion resistance: It was conducted using the coated plates for test obtained in Example 3 and Comparative Example 3. As the coated plate for test in Example 3, a steel plate, obtained by electrodeposition coating on a plastics-covered metal plate (b) of the size 7 cm×15 cm, in which half of one surface of the metal plate had been covered with polyester film, in the same manner as in Example 2, and curing the coating film by heating, was used.

A straight line cutting was made at the boundary portion between the electrodeposition coating film and the portion covered with plastics or the powder coating film portion in these coated plates for test reaching the substrate passing through the organic layer by a cutter. After being dipped in a 5% aqueous solution of sodium chloride at 55° C. for 240 hours, the test piece was pulled up, washed with water and dried. Then a piece of adhesive cellophane tape was stuck on the line of the cutting and the coating surface was observed, after the tape was rapidly peeled off at 20° C.

○ shows that the width of peeling off of the electrodeposition coating film from the cutting line is less than 3 mm, Δ shows that the width of peeling off of the electrodeposition coating film from the cutting line is 3–5 mm, and X shows that the width of peeling off of the electrodeposition coating film from the cutting line is more than 5 mm.

What is claimed is:

1. A car body coating process which comprises forming a shell body using a metal plate covered with a preformed plastic film or sheet to the main outer portions of a car body and then coating the exposed metal portion in the shell body by electrodeposition coating.

2. A car body coating process which comprises forming a shell body equipping car parts, which have been made by cutting, molding and joining a metal plate covered with a preformed plastic film or sheet for the main outer portions of a car body, to a previously assembled main body of a car body, and then coating the exposed metal portion in the shell body by electrodeposition.

3. A process set forth in claim 1 or claim 2 in which the metal plate covered with a preformed plastic film or sheet is a metal plate for car body formation on which a film or sheet consisting of thermoplastic resin is stuck at least on one surface.

4. A process set forth in claim 1 or claim 2 in which the thickness of the covering layer of plastics of the metal plate covered with a preformed plastic film or sheet is in the range of 1–100 μm.

5. A process set forth in claim 1 or claim 2 in which an electrodeposition paint is used for the electrodeposition coating, is a cationic electrodeposition paint.

6. A process set forth in claim 5 in which the electrodeposition paint is a water paint containing a base resin having a hydroxyl group(s) and a cationizable group(s) and a blocked polyisocyanate compound.

7. A process set forth in claim 6 in which the base resin has a hydroxyl group equivalent in the range of 20–5000 mgKOH/g.

8. A process set forth in claim 1 or claim 2 in which the thickness of the coating film by electrodeposition coating as a cured film is in the range of about 10—about 40 $\mu$m.

9. A car body obtained by the process set forth in claim 1 or claim 2.

10. A process set forth in claim 1 or claim 2 in which the thickness of the covering layer of plastics of the metal plate covered with a preformed plastic film or sheet is in the range of 3–75 $\mu$m.

11. A process set forth in claim 6 in which the base resin has a hydroxyl group equivalent in the range of 100–1000 mgKOH/g.

12. A process set forth in claim 1 or claim 2 in which the thickness of the coating film by electrodeposition coating as a cured film is in the range of 10–20 $\mu$m.

* * * * *